US009676604B2

(12) United States Patent
MacDonald

(10) Patent No.: US 9,676,604 B2
(45) Date of Patent: Jun. 13, 2017

(54) CONVERTIBLE BEVERAGE SERVING STATION

(71) Applicant: AISLE ADVERTISING, Minnetonka, MN (US)

(72) Inventor: Mark R. MacDonald, Minnetonka, MN (US)

(73) Assignee: Aisle Advertising, Minnetonka, MN (US)

( * ) Notice: Subject to any disclaimer, the term of this patent is extended or adjusted under 35 U.S.C. 154(b) by 0 days.

(21) Appl. No.: 14/663,808

(22) Filed: Mar. 20, 2015

(65) Prior Publication Data

US 2015/0266712 A1 Sep. 24, 2015

Related U.S. Application Data

(60) Provisional application No. 61/968,784, filed on Mar. 21, 2014.

(51) Int. Cl.
*B67D 1/06* (2006.01)

(52) U.S. Cl.
CPC ..... *B67D 1/06* (2013.01); *B67D 2210/00031* (2013.01); *B67D 2210/00034* (2013.01)

(58) Field of Classification Search
USPC ..... 222/108, 129.1, 130, 146.6, 538, 173, 222/113; 312/313, 302, 300, 328;
(Continued)

(56) References Cited

U.S. PATENT DOCUMENTS

| | | | |
|---|---|---|---|
| 316,928 | A | 4/1885 | Wysong |
| 1,055,884 | A | 3/1913 | Davidson |

(Continued)

FOREIGN PATENT DOCUMENTS

| | | |
|---|---|---|
| EP | 0575275 | 12/1993 |
| JP | 1005059 | 1/1998 |
| WO | 2010068832 | 6/2010 |

OTHER PUBLICATIONS

File History for U.S. Appl. No. 12/333,172 downloaded Oct. 5, 2015 (173 pages).

(Continued)

*Primary Examiner* — Donnell Long
(74) *Attorney, Agent, or Firm* — Pauly, DeVries Smith & Deffner, L.L.C.

(57) ABSTRACT

Embodiments of the invention include convertible beverage serving stations and related methods. The convertible beverage serving station can include a housing, a substantially planar serving platform, a connection device, a first columnar serving tower, and a releasable mounting interface. The housing can include an interior, a front wall, a first side wall, a second side wall, and a base. The substantially planar serving platform can include one or more apertures. The connection device can be configured to allow the serving platform to open upward allowing access to the interior of the housing. The first columnar serving tower can include a top and a bottom. The top can include one or more orifices for dispensing a beverage. The releasable mounting interface can include a central channel, a bottom portion, and a top portion. Other embodiments are also included herein.

17 Claims, 18 Drawing Sheets

(58) Field of Classification Search
USPC ..... 62/389
See application file for complete search history.

(56) References Cited

U.S. PATENT DOCUMENTS

| | | | | | |
|---|---|---|---|---|---|
| 1,376,608 | A | | 5/1921 | Curtiss | |
| 1,571,098 | A | | 1/1926 | Rimke | |
| 2,122,969 | A | | 7/1938 | Whitcomb | |
| 2,182,116 | A | * | 12/1939 | Copeman | B67D 1/06 220/592.19 |
| 2,199,718 | A | * | 5/1940 | Ayers | B67D 1/06 312/140.1 |
| 2,496,221 | A | | 1/1950 | Koch | |
| 2,499,062 | A | | 2/1950 | Greenberg | |
| 2,547,808 | A | | 4/1951 | Burrage | |
| 2,556,870 | A | | 6/1951 | Clark | |
| 2,764,462 | A | | 9/1956 | Mcdonald | |
| 2,988,082 | A | | 6/1961 | Kuhn | |
| 3,009,752 | A | | 11/1961 | Margulis | |
| 3,013,852 | A | | 12/1961 | Rockola | |
| 3,156,510 | A | | 11/1964 | Hindin et al. | |
| 3,195,779 | A | * | 7/1965 | Nicko | B67D 1/04 222/129.1 |
| 3,232,489 | A | * | 2/1966 | Buffington | B67D 1/06 211/150 |
| 3,319,801 | A | | 5/1967 | Nordstrom | |
| 3,327,902 | A | * | 6/1967 | Melvin | B67D 1/06 222/108 |
| 3,436,092 | A | | 4/1969 | Werner | |
| 3,612,848 | A | | 10/1971 | Koch et al. | |
| 3,697,363 | A | | 10/1972 | Martinez | |
| 3,954,068 | A | | 5/1976 | Roberts et al. | |
| 3,983,583 | A | * | 10/1976 | Herman | A47B 69/00 312/140.2 |
| D275,250 | S | | 8/1984 | Kirsner | |
| 4,993,782 | A | | 2/1991 | Williams | |
| 5,094,388 | A | * | 3/1992 | Chapman, Jr. | E03B 9/20 222/108 |
| D346,867 | S | | 5/1994 | Montilla | |
| D351,299 | S | | 10/1994 | Barrish | |
| 5,373,428 | A | | 12/1994 | Day | |
| D362,097 | S | | 9/1995 | Brown | |
| 5,533,241 | A | | 7/1996 | Mcconnell et al. | |
| 5,542,554 | A | | 8/1996 | Resnick et al. | |
| 5,622,119 | A | | 4/1997 | Hsieh et al. | |
| 5,640,912 | A | | 6/1997 | Diffrient | |
| D381,529 | S | | 7/1997 | Ugalde | |
| D395,368 | S | | 6/1998 | Adenau et al. | |
| 5,816,405 | A | | 10/1998 | Carriger et al. | |
| 5,882,098 | A | | 3/1999 | Salley et al. | |
| 5,927,214 | A | | 7/1999 | Schwartz et al. | |
| 6,095,056 | A | | 8/2000 | Schumacher | |
| 6,240,855 | B1 | | 6/2001 | Pirkl et al. | |
| 7,008,073 | B2 | * | 3/2006 | Stuhlmacher, II | E03C 1/0404 362/101 |
| 7,278,644 | B2 | | 10/2007 | Villarreal | |
| 7,314,010 | B2 | | 1/2008 | George | |
| 7,387,151 | B1 | | 6/2008 | Payne | |
| 7,665,709 | B2 | | 2/2010 | Cvek | |
| 8,127,695 | B2 | | 3/2012 | Macdonald et al. | |
| 2002/0145368 | A1 | | 10/2002 | Brown | |
| 2004/0226210 | A1 | | 11/2004 | Kaur | |
| 2006/0076858 | A1 | | 4/2006 | Nohl | |
| 2008/0093384 | A1 | * | 4/2008 | Fire | B67D 1/0084 222/144.5 |
| 2008/0142548 | A1 | * | 6/2008 | Moen | B01F 13/1055 222/129.1 |
| 2010/0148024 | A1 | | 6/2010 | Macdonald et al. | |
| 2011/0108240 | A1 | * | 5/2011 | Bax | B67D 1/06 165/104.19 |
| 2014/0151402 | A1 | * | 6/2014 | Jannatkhah | B67D 1/0858 222/108 |
| 2015/0135763 | A1 | * | 5/2015 | Lee | F25D 3/06 62/460 |

OTHER PUBLICATIONS

"International Preliminary Report on Patentability," for PCT/US09/67617, corresponding to U.S. Appl. No. 12/333,172, mailed Jun. 23, 2011 (7 pages).

"International Search Report and Written Opinion," for PCT/US2009/067617 mailed Mar. 25, 2010 (24 pages).

* cited by examiner

CONVERTIBLE BEVERAGE SERVING STATION

This application claims the benefit of U.S. Provisional Application No. 61/968,784, filed Mar. 21, 2014, the content of which is herein incorporated by reference in its entirety.

FIELD OF THE INVENTION

The present invention relates to convertible beverage serving stations and related methods.

BACKGROUND OF THE INVENTION

Beverages are commonly served from counter height fixtures (such as from a bar) in many eating and drinking establishments. Usually, such fixtures for serving beverages are permanently mounted in the establishment. Moving such permanent fixtures to another location would typically require at least partial physical destruction of the permanent fixtures. In addition, such permanent fixtures leave elements thereof exposed, thus making them susceptible to possible damage when not in use.

SUMMARY OF THE INVENTION

Embodiments of the invention include convertible beverage serving stations and related methods. In an embodiment, the invention includes a convertible beverage serving station. The convertible beverage serving station can include a housing, a substantially planar serving platform, a connection device, a first columnar serving tower, and a releasable mounting interface. The housing can include an interior, a front wall, a first side wall, a second side wall, and a base. The base can be connected to the front wall, the first side wall, the second side wall. The substantially planar serving platform can include one or more apertures. The connection device can be configured to allow the serving platform to open upward allowing access to the interior of the housing. The first columnar serving tower can include a top and a bottom. The top can include one or more orifices. The one or more orifices can be for dispensing a liquid. The releasable mounting interface can include a central channel, a bottom portion, and a top portion. The bottom portion can be configured to pass through one of the apertures in the substantially planar serving platform. The top portion can be configured to mate with the bottom.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present invention is defined by the appended claims and their legal equivalents.

BRIEF DESCRIPTION OF THE FIGURES

The invention may be more completely understood in connection with the following drawings, in which.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

The embodiments of the present invention described herein are not intended to be exhaustive or to limit the invention to the precise forms disclosed in the following detailed description. Rather, the embodiments are chosen and described so that others skilled in the art can appreciate and understand the principles and practices of the present invention.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

Embodiments herein include convertible beverage serving stations that can be quickly deployed and packed up in order to facilitate serving of beverages from many locations and in many environments. In various embodiments herein, the beverage serving station can have a deployed configuration and a storage configuration. In the deployed configuration, one or more serving towers can be attached to a serving platform and one or more integrated tables can be deployed to provide counter space. In the storage configuration, the components of the system (including the serving towers) can be put within the protective housing of the serving station.

Figure 1:
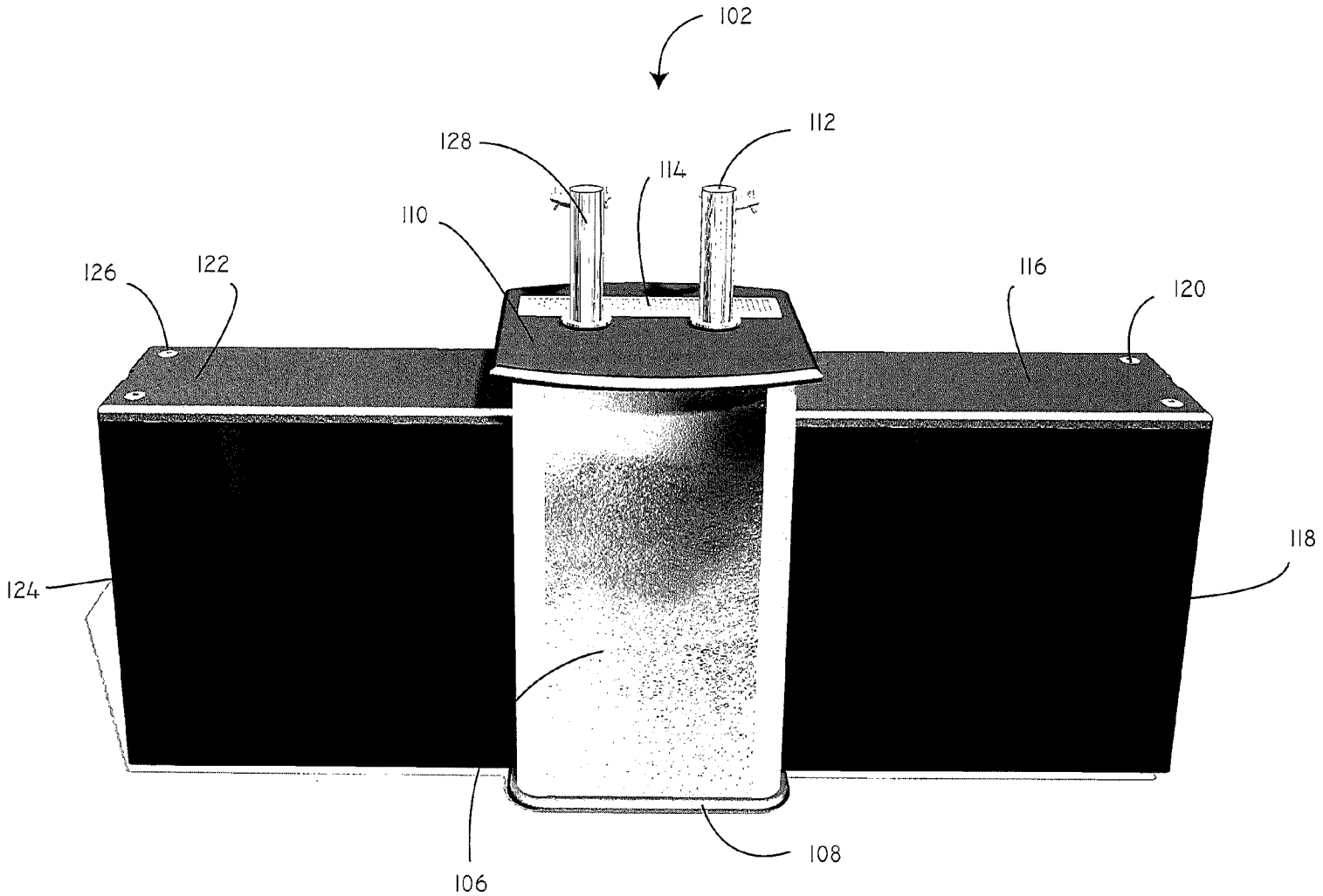
FIG. 1 is a schematic view of a convertible beverage serving station in accordance with various embodiments herein.

Referring now to FIG. 1, a schematic view of a convertible beverage serving station 102 is shown in accordance with various embodiments herein. The convertible beverage serving station 102 includes a housing 104, a substantially planar serving platform 110, and a first columnar serving tower 112. The substantially planar serving platform 110 can include grate (or drip tray) 114. In some embodiments, a rotary type clip can be used to hold the grate in place on the serving platform 110. The rotary type clip can be rotated in order to allow the grate to be lifted up and allow cleaning underneath. The housing 104 includes a front wall 106 and a base 108. The housing 104 can be made of various materials including metals, polymers, cellulosic materials, glass, composites or the like. The convertible beverage serving station 102 can include a first table top 116. The convertible beverage serving station 102 can include a first skirt member 118. In some embodiments, the skirt member can be made of a fabric. In some embodiments, the skirt member can have graphics printed thereon. The first table top 116 can include an aperture 120. The aperture 120 can be used for mounting other components or can be used to pass cords from one side of the table top to the other. The convertible beverage serving station 102 can include a second table top 122. The convertible beverage serving station 102 can include a second skirt member 124. The second table top 122 can also include an aperture 126. In some embodiments, the convertible beverage serving station 102 can also include a second columnar serving tower 128.

Figure 2:
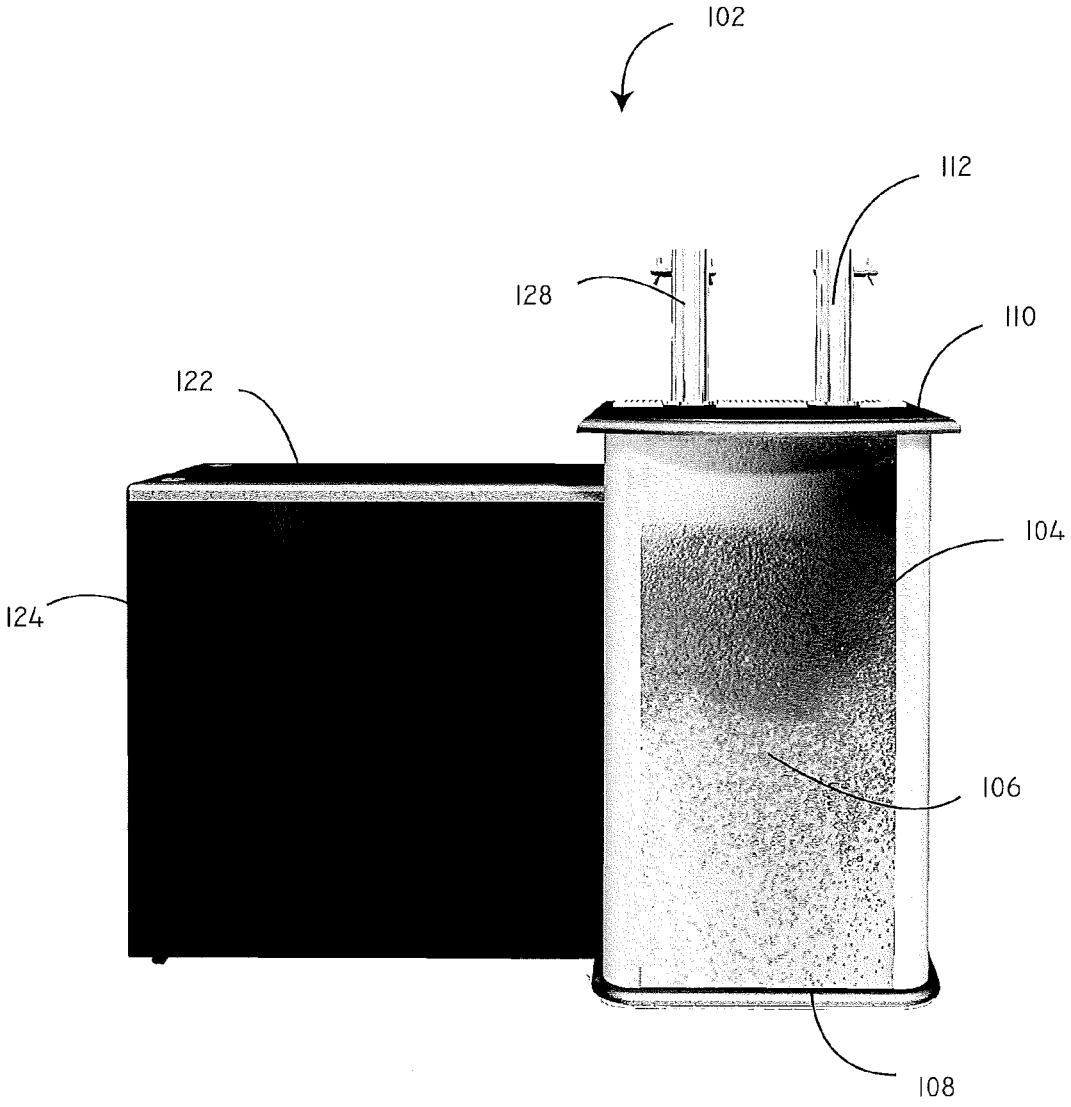
FIG. 2 is a schematic view of a convertible beverage serving station in accordance with various embodiments herein.

The tables can be collapsible and can be stored within the housing 104 such that different serving configurations are possible. Referring now to FIG. 2, a schematic view of a convertible beverage serving station 102 is shown in accordance with various embodiments herein. The convertible beverage serving station 102 includes a housing 104, a substantially planar serving platform 110, and a first columnar serving tower 112. The housing 104 includes a front wall 106 and a base 108. In this view, only the second table top 122 has been deployed, while the first table top 116 is stored within the housing 104.

Figure 3:
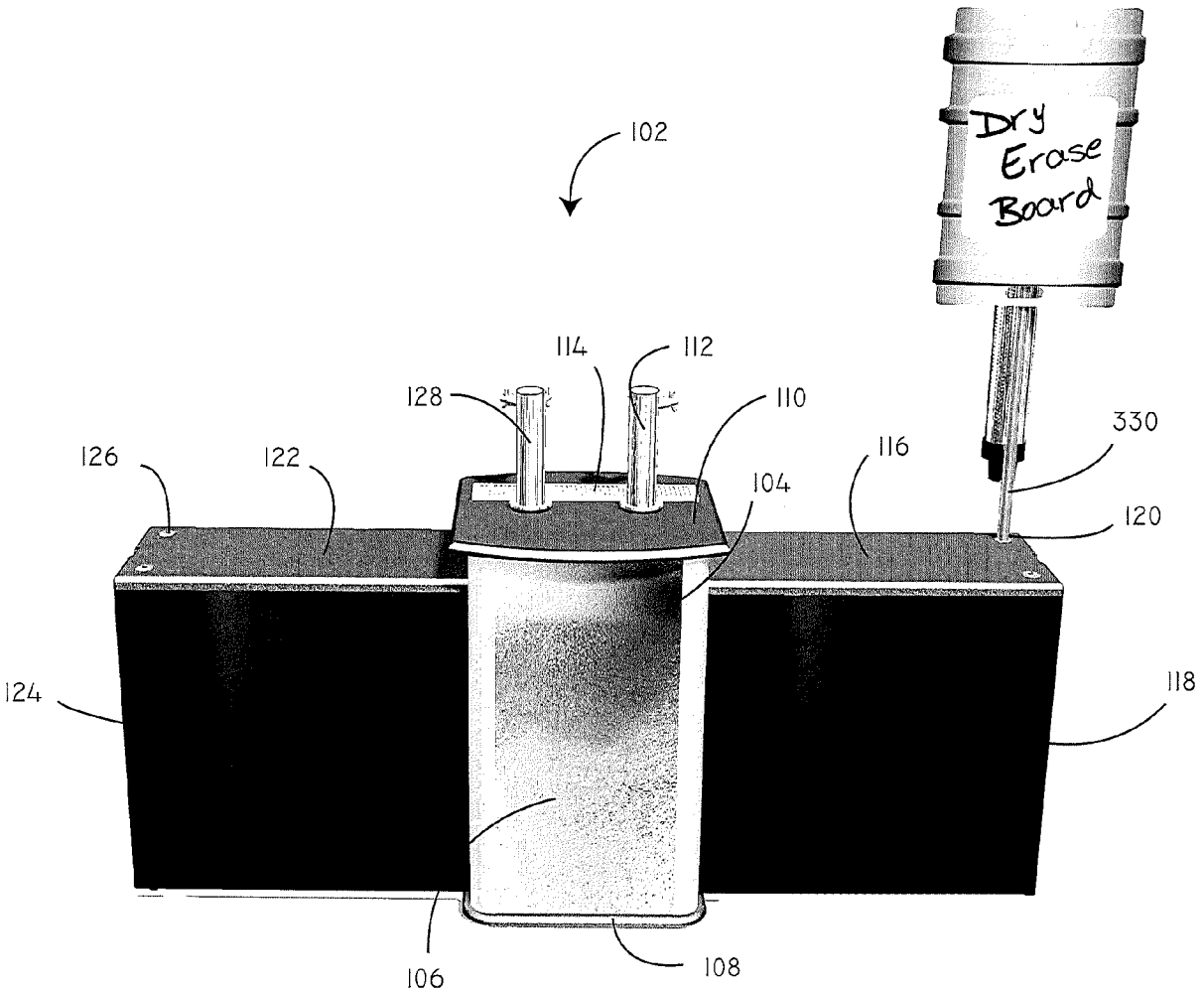
FIG. 3 is a schematic view of a convertible beverage serving station in accordance with various embodiments herein.

It will be appreciated that various accessory objects can be attached to the convertible beverage serving station 102. Referring now to FIG. 3, a schematic view of a convertible beverage serving station 102 is shown in accordance with various embodiments herein. The convertible beverage serving station 102 includes a housing 104, a substantially planar serving platform 110, and a first columnar serving tower 112. The housing 104 includes a front wall 106 and a base 108. The base 108 can include grate 114. The convertible beverage serving station 102 can include first table top 116. The convertible beverage serving station 102 can include first skirt member 118. The first table top 116 can include aperture 120. The convertible beverage serving station 102 can include stand pole 330 (or another type of accessory) that can fit within the aperture 120 on the first table top 116. In this view, a cup dispenser and a dry erase board are shown mounted to the stand pole 330.

Figure 4:
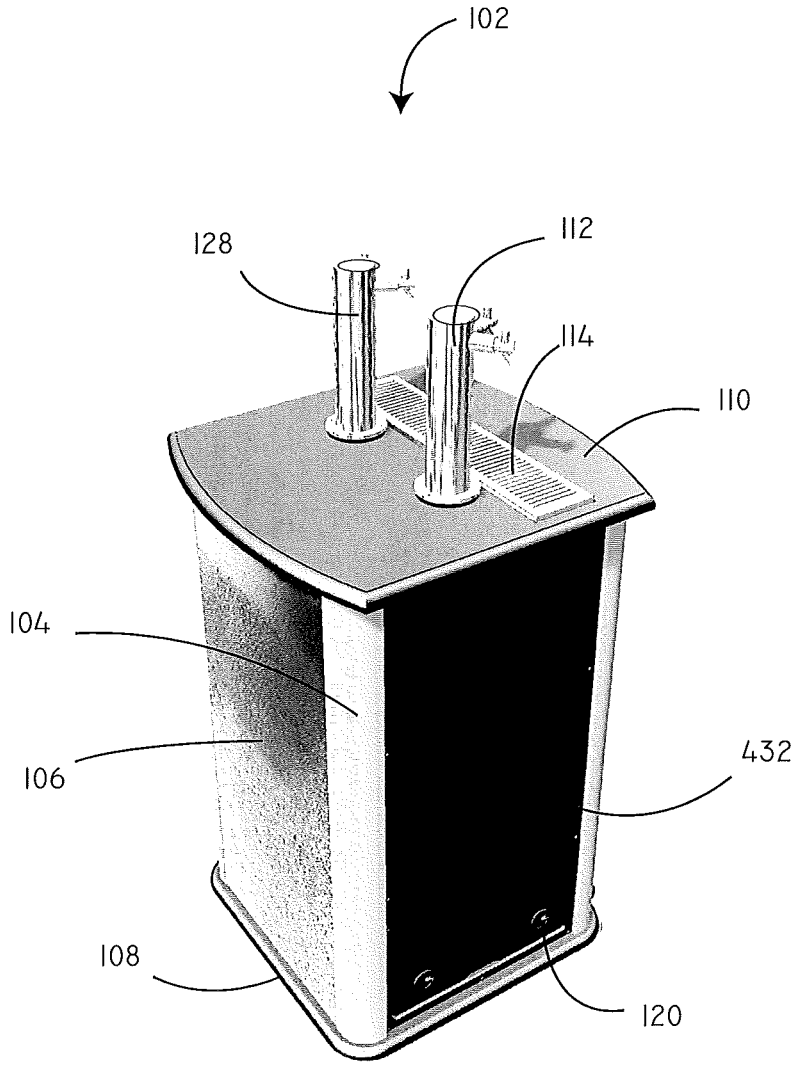
FIG. 4 is a schematic view of a convertible beverage serving station in accordance with various embodiments herein.

Referring now to FIG. 4, a schematic view of a convertible beverage serving station is shown in accordance with various embodiments herein. The convertible beverage serving station 102 includes a housing 104, a substantially planar serving platform 110, and a first columnar serving tower 112. The housing 104 includes a front wall 106, a first side wall 432, and a base 108. The base 108 can include grate 114. The first table top 116 can include aperture 120. The convertible beverage serving station 102 can include second columnar serving tower 128.

Figure 5:
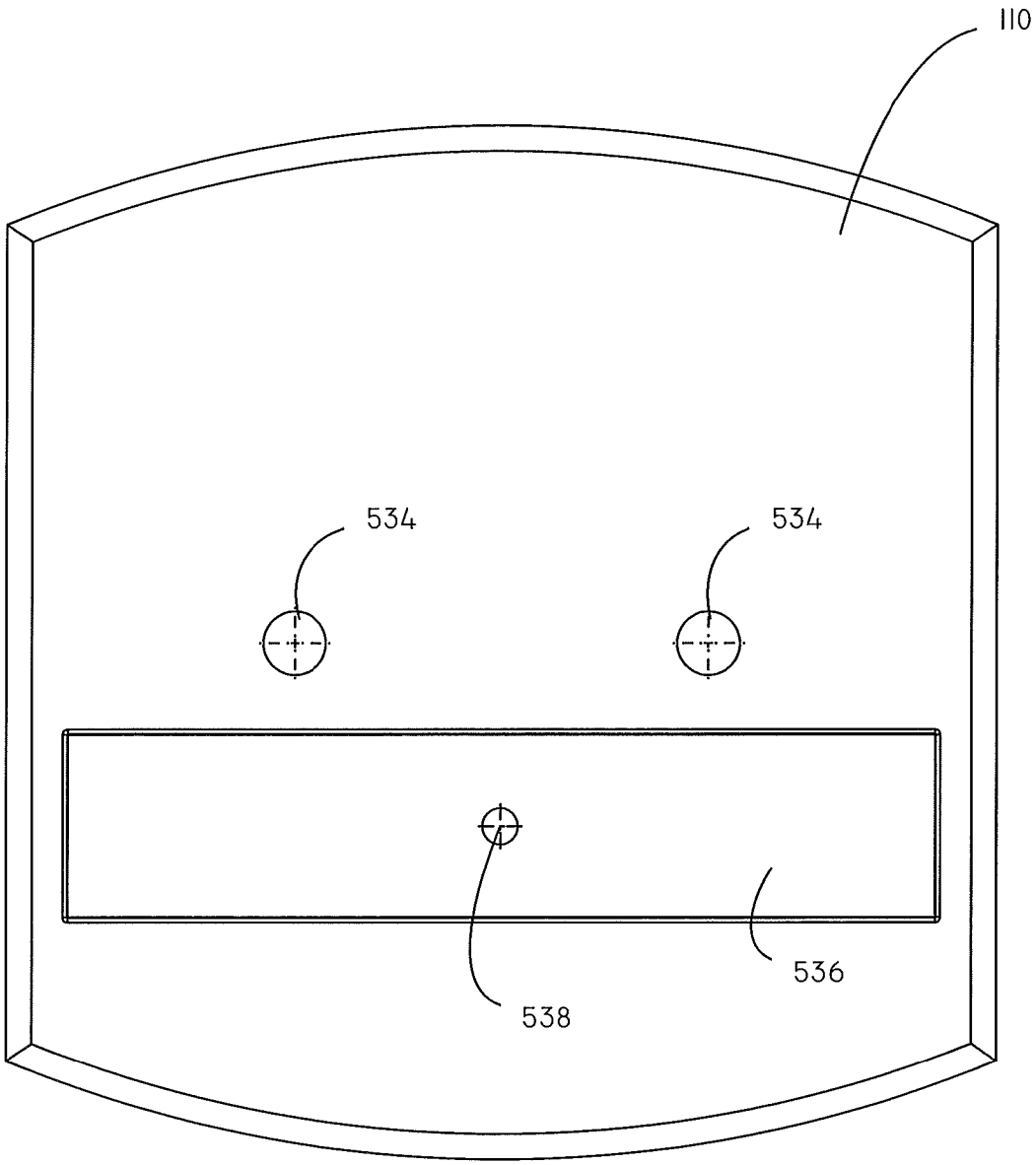
FIG. 5 is a schematic top view of a serving platform in accordance with various embodiments herein.

Referring now to FIG. 5, a schematic top view of a serving platform is shown in accordance with various embodiments herein. The substantially planar serving platform 110 includes apertures 534. These apertures can be used for the mounting of the substantially columnar serving towers. The substantially planar serving platform 110 can include rectangular depression 536. A grate (not show in this view) can be at least partially disposed within the rectangular depression 536. The substantially planar serving platform 110 can include aperture 538 that is disposed in the rectangular depression 536.

Figure 6:
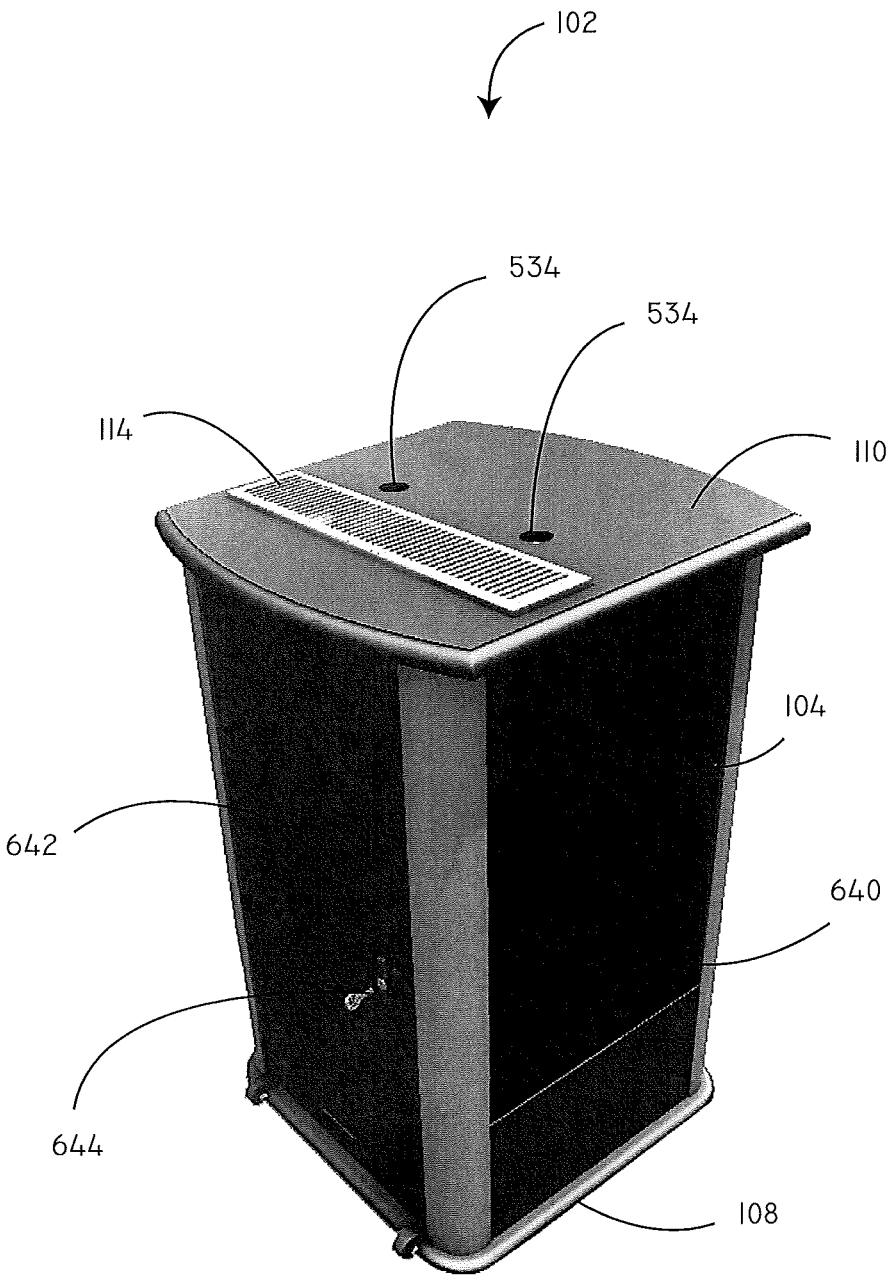
FIG. 6 is a schematic view of a convertible beverage serving station in accordance with various embodiments herein.

It will be appreciated that components of the system can be protected from damage when they are packed and stored within the housing 104 (a storage configuration). Referring now to FIG. 6, a schematic view of a convertible beverage serving station is shown in a packed-up storage configuration in accordance with various embodiments herein. The convertible beverage serving station 102 includes a housing 104 and a substantially planar serving platform 110. The housing 104 includes a second side wall 640 and a base 108. The substantially planar serving platform 110 includes apertures 534. The base 108 can include grate 114. The convertible beverage serving station 102 can include back door 642. The back door 642 can include locking mechanism 644 to secure items inside the housing 104.

Figure 7:
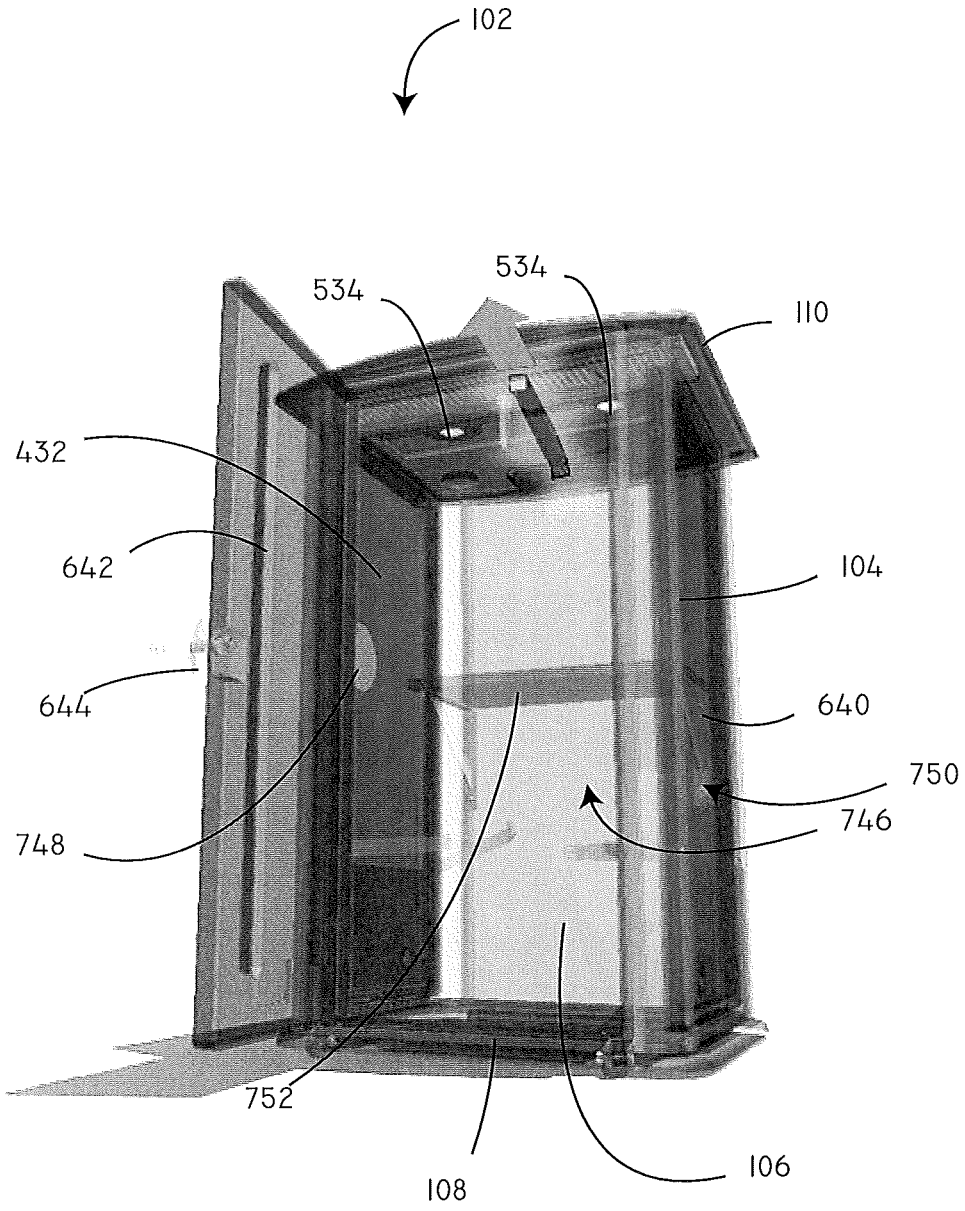
FIG. 7 is a schematic view of a convertible beverage serving station in accordance with various embodiments herein.

Referring now to FIG. 7, a schematic view of a convertible beverage serving station is shown in accordance with various embodiments herein. The convertible beverage serving station 102 includes a housing 104 and a substantially planar serving platform 110. The housing 104 includes an interior 746, a front wall 106, a first side wall 432, a second side wall 640, and a base 108. The substantially planar serving platform 110 includes apertures 534. The first side wall 432 can include aperture 748. The second side wall 640 can include recessed pocket 750. The recessed pocket 750 can be used to store the table top and table leg when they are not in use. A corresponding recessed pocket can also be included in the first side wall. The convertible beverage serving station 102 can include back door 642. The back door 642 can include locking mechanism 644. The convertible beverage serving station 102 can include a shelf 752.

Figure 8:
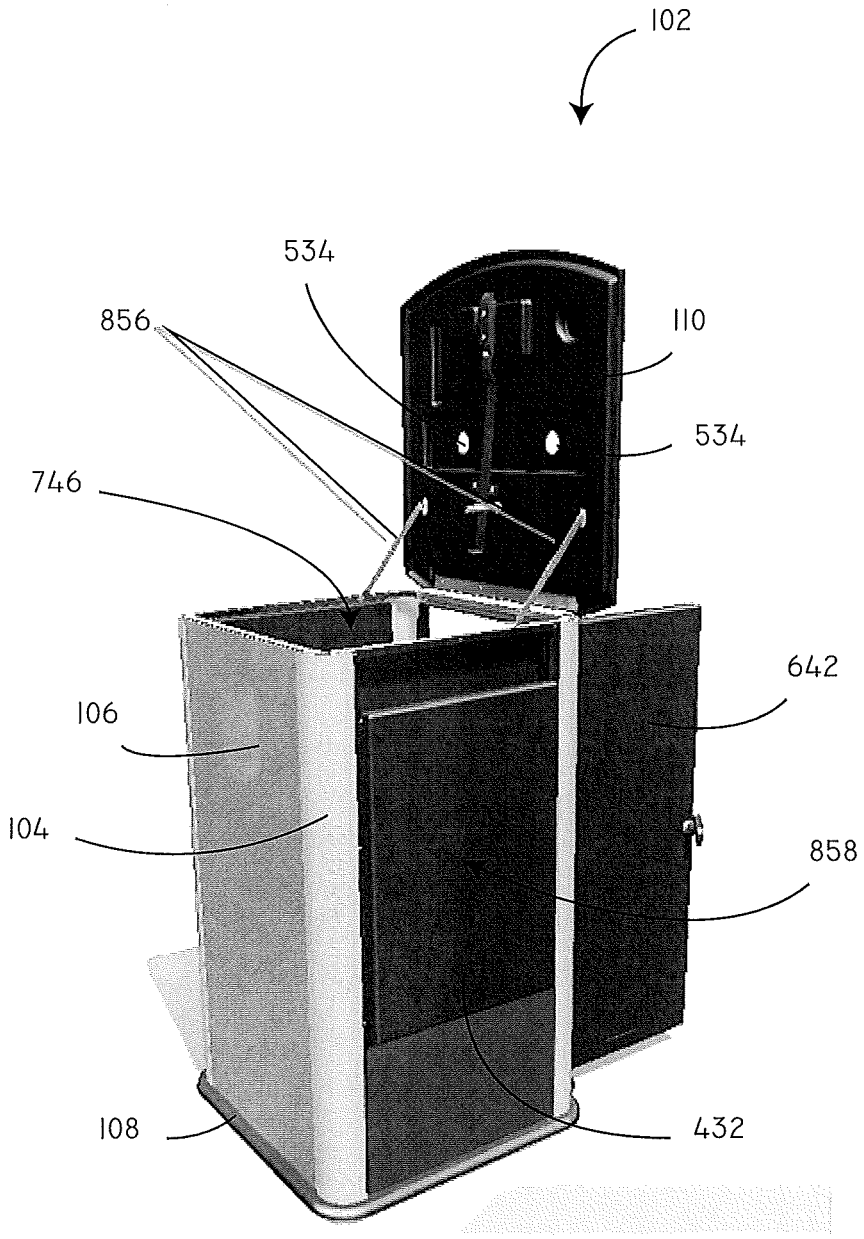
FIG. 8 is a schematic view of a convertible beverage serving station in accordance with various embodiments herein.

In various embodiments herein, the serving platform can be opened to allow access to the interior of the housing. Referring now to FIG. 8, a schematic view of a convertible beverage serving station is shown in accordance with various embodiments herein. The convertible beverage serving station 102 includes a housing 104, a substantially planar serving platform 110, and a connection device 854. The connection device 854 (such as a hinge or other type of hardware) can be used to attach the serving platform 110 to the housing 104 in way that allows the serving platform 110 to be opened upward. The housing 104 includes an interior 746, a front wall 106, a first side wall 432, and a base 108. The substantially planar serving platform 110 includes apertures 534. The convertible beverage serving station 102 can include connection arm 856. The connection arm 856 can be substantially rigid in some embodiments with a pivot point in the middle. In that manner, the connection arm 856 can be used to prop the serving platform 110 in an open position. The first side wall 432 can include recessed pocket 858.

Figure 9:
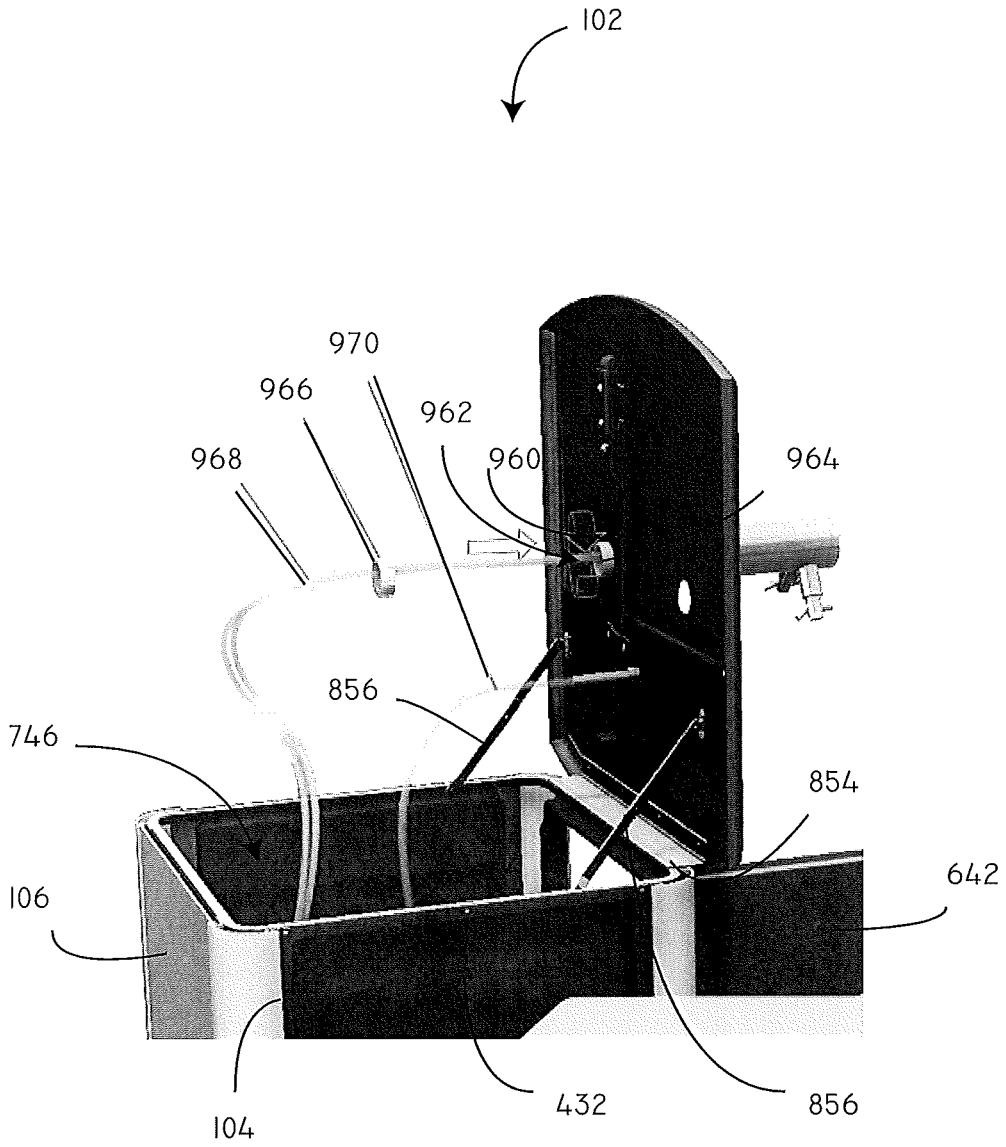
FIG. 9 is a schematic view of a portion of a convertible beverage serving station in accordance with various embodiments herein.

The serving towers can be easily attached and detached from the serving platform in order to convert the serving station between a deployed configuration and a storage configuration. Referring now to FIG. 9, a schematic view of a convertible beverage serving station is shown in accordance with various embodiments herein. The convertible beverage serving station 102 includes a housing 104, a connection device 854, a first columnar serving tower 112, and a releasable mounting interface 960. The releasable mounting interface 960 includes a central channel 962 and a bottom portion 964. The bottom portion 964 can pass through an aperture in the serving platform 110. In some embodiments, the bottom portion 964 can include threads. The releasable mounting interface 960 can include nut 966. The nut 966 can have a larger diameter than the aperture passing through the serving platform 110 and can engage with threads on the bottom portion 964, thus securing the releasable mounting interface 960 and the substantially columnar serving tower 112 to the serving platform. The convertible beverage serving station 102 can also include fluid transfer conduit 968. The convertible beverage serving station 102 can also include waste fluid disposal conduit 970. The convertible beverage serving station 102 can include back door 642.

The substantially planar serving platform 110 can also include a spring loaded slam latch 961. The spring loaded slam latch 961 can have a front portion comprising a downward facing curved tongue element that can contact and secure under a lip on the front wall 106. The spring loaded slam latch 961 can include a spring that provides a spring force to push the slam latch tongue element forward and helps it maintain engagement with the lip. The spring loaded slam latch 961 can also have a back portion comprising a release handle disposed under the substantially planar serving platform 110 adjacent to the back door 642. When a backward force is applied to the release handle, the spring force provided by the spring can be overcome and the tongue portion can disengage from the lip on the front wall, thereby allowing the front of the substantially planar serving platform 110 to be lifted up. The curvature of the tongue portion allows the slam latch 961 to reengage the lip when a downward force is applied to the substantially planar serving platform 110.

Figure 10:
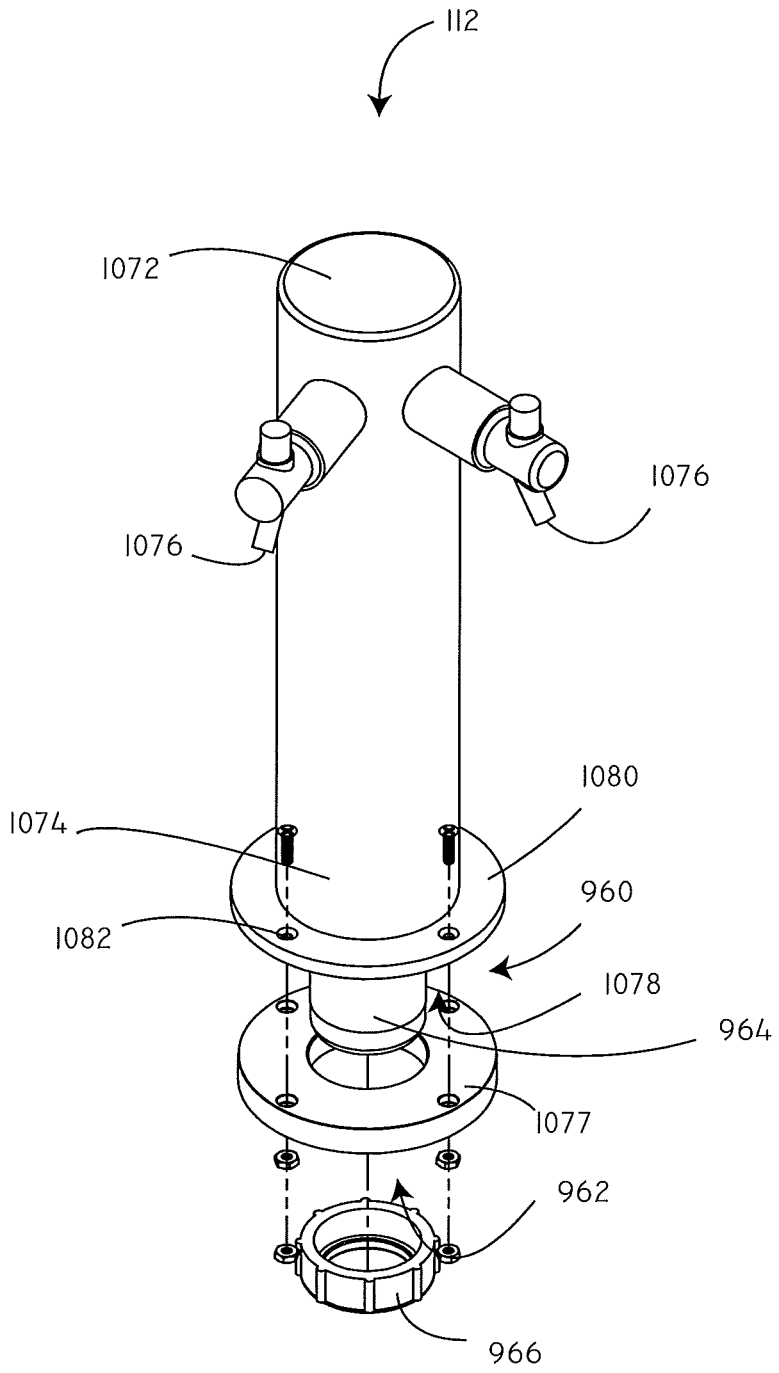
FIG. 10 is a schematic view of a columnar serving tower and a releasable mounting interface in accordance with various embodiments herein.

Referring now to FIG. 10, a schematic view of a columnar serving tower and a releasable mounting interface is shown in accordance with various embodiments herein. The convertible beverage serving station 102 includes a substantially planar serving platform 110. The first columnar serving tower 112 includes a top 1072 and a bottom 1074. The top 1072 includes one or more orifices 1076. The releasable mounting interface 960 includes a central channel 962, a bottom portion 964, and a top portion 1078 and an attachment puck 1077. The first columnar serving tower 112 can include flange 1080. The flange 1080 can include apertures 1082. The releasable mounting interface 960 can include nut 966.

Figure 11:
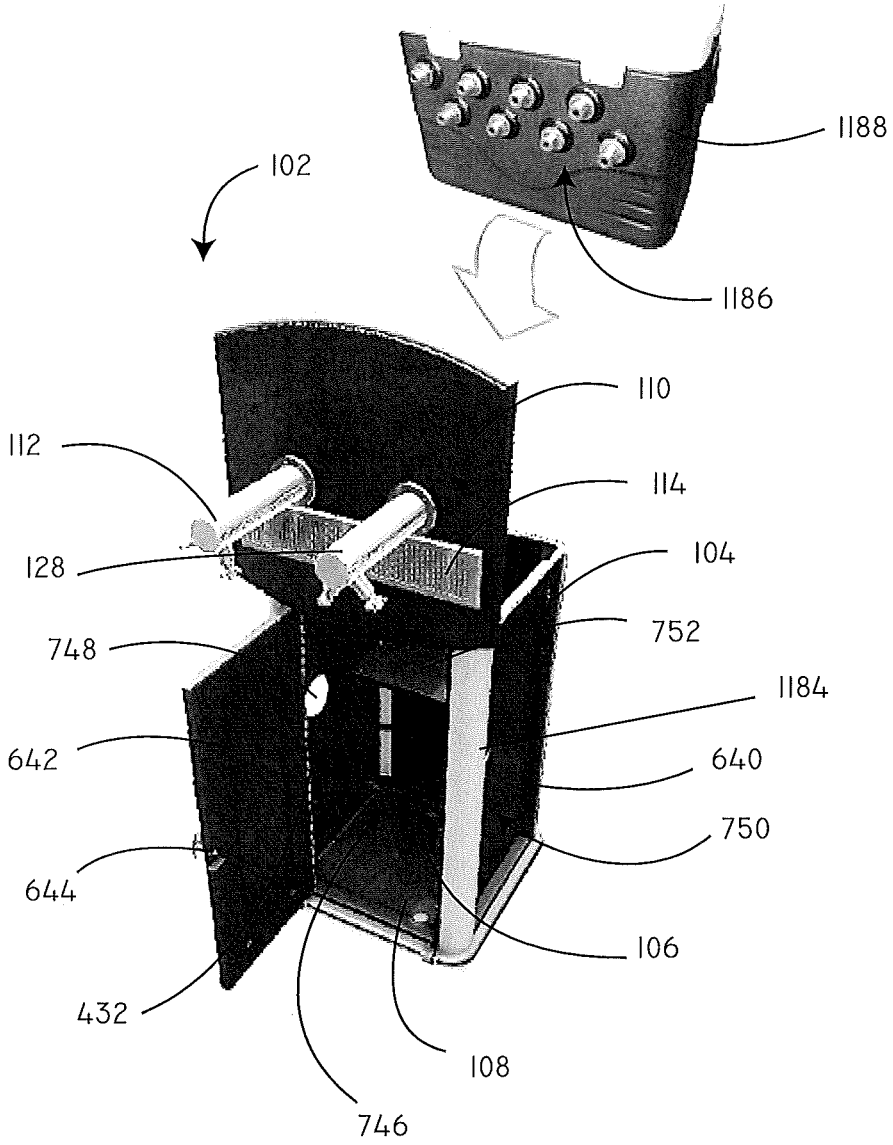
FIG. 11 is a schematic view of a convertible beverage serving station in accordance with various embodiments herein.

Referring now to FIG. 11, a schematic view of a convertible beverage serving station is shown in accordance with various embodiments herein. The convertible beverage serving station 102 includes a housing 104, a substantially planar serving platform 110, and a first columnar serving tower 112. The housing 104 includes an interior 746, a front wall 106, a first side wall 432, a second side wall 640, and a base 108. The first side wall 432 can include aperture 748. The second side wall 640 can include aperture 1184. The base 108 can include grate 114. The second side wall 640 can include recessed pocket 750. The convertible beverage serving station 102 can include second columnar serving tower 128. The convertible beverage serving station 102 can include back door 642. The back door 642 can include locking mechanism 644. The convertible beverage serving station 102 can include fluid connection manifold 1186. The fluid connection manifold 1186 can include an insulated box 1188. The fluid connection manifold 1186 and the insulated box 1188 can facilitate attaching and detaching various fluid conduits so as to deliver a beverage from a container (such as a barrel or other container) through the interior of the housing and to the columnar serving tower. The convertible beverage serving station 102 can include shelf 752. In some embodiments, the insulated box can be configured to be disposed on the shelf.

Figure 12:
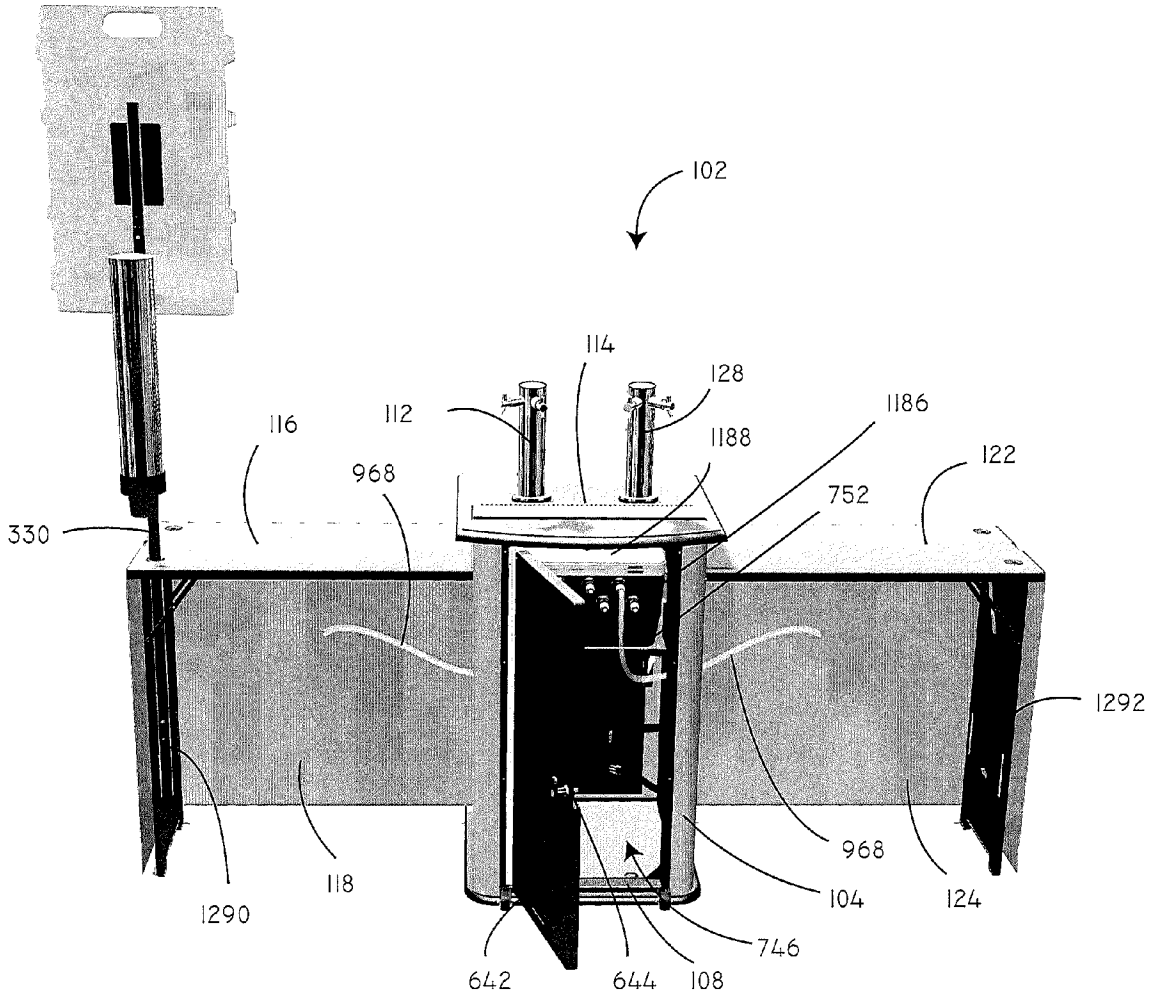
FIG. 12 is a schematic view of a convertible beverage serving station in accordance with various embodiments herein.

Referring now to FIG. 12, a schematic view of a convertible beverage serving station is shown in accordance with various embodiments herein. The convertible beverage serving station 102 includes a housing 104, a substantially planar serving platform 110, and a first columnar serving tower 112. The housing 104 includes an interior 746 and a base 108. The convertible beverage serving station 102 can include fluid transfer conduit 968. The base 108 can include grate 114. The convertible beverage serving station 102 can include first table top 116. The convertible beverage serving station 102 can include first leg 1290. The convertible beverage serving station 102 can include first skirt member 118. The convertible beverage serving station 102 can include stand pole 330. The convertible beverage serving station 102 can include second table top 122. The convertible beverage serving station 102 can include second leg 1292. The convertible beverage serving station 102 can include second skirt member 124. The convertible beverage serving station 102 can include second columnar serving tower 128. The convertible beverage serving station 102 can include back door 642. The back door 642 can include locking mechanism 644. The convertible beverage serving station 102 can include fluid connection manifold 1186. The fluid connection manifold 1186 can include insulated box 1188. The convertible beverage serving station 102 can include shelf 752.

Figure 13:
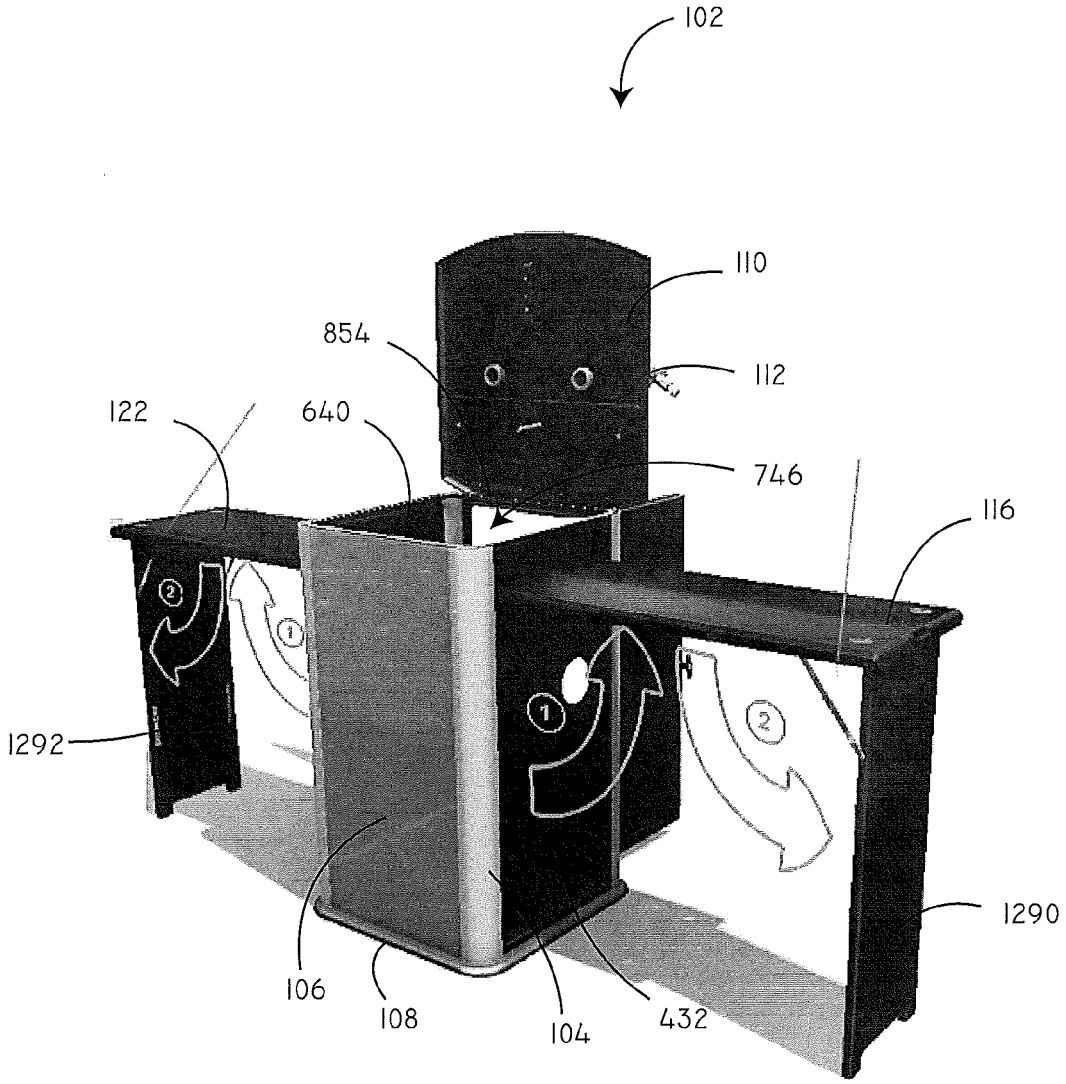
FIG. 13 is a schematic view of a convertible beverage serving station in accordance with various embodiments herein.

Referring now to FIG. 13, a schematic view of a convertible beverage serving station is shown in accordance with various embodiments herein. The convertible beverage serving station 102 includes a housing 104, a substantially planar serving platform 110, a connection device 854, and a first columnar serving tower 112. The housing 104 includes an interior 746, a front wall 106, a first side wall 432, a second side wall 640, and a base 108. The convertible beverage serving station 102 can include first table top 116. The convertible beverage serving station 102 can include first leg 1290. The convertible beverage serving station 102 can include second table top 122. The convertible beverage serving station 102 can include second leg 1292.

Figure 14:
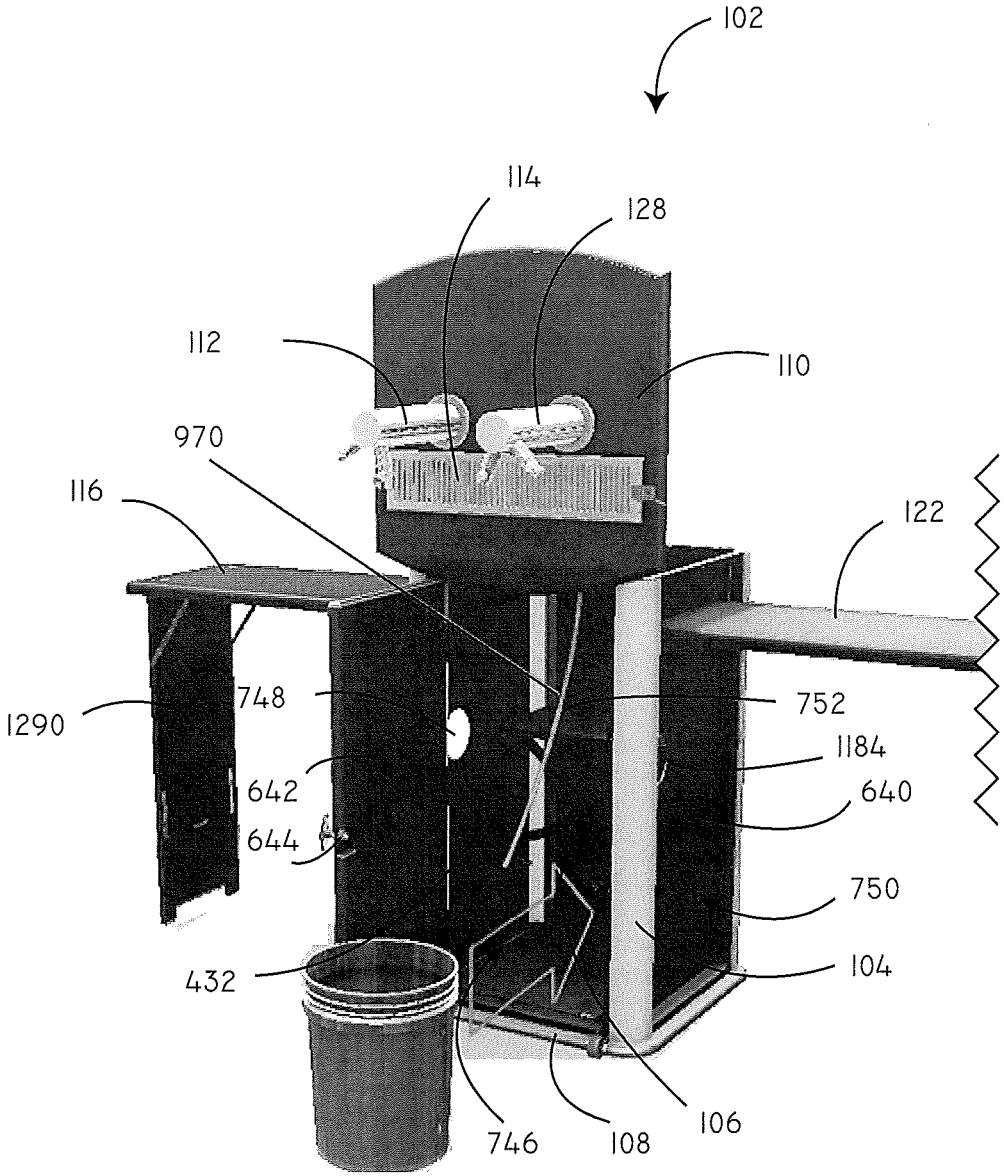
FIG. 14 is a schematic view of a convertible beverage serving station in accordance with various embodiments herein.

Referring now to FIG. 14, a schematic view of a convertible beverage serving station is shown in accordance with various embodiments herein. The convertible beverage serving station 102 includes a housing 104, a substantially planar serving platform 110, and a first columnar serving tower 112. The housing 104 includes an interior 746, a front wall 106, a first side wall 432, a second side wall 640, and a base 108. The first side wall 432 can include aperture 748. The second side wall 640 can include aperture 1184. The base 108 can include grate 114. The convertible beverage serving station 102 can include waste fluid disposal conduit 970. The convertible beverage serving station 102 can include first table top 116. The convertible beverage serving station 102 can include first leg 1290. The convertible beverage serving station 102 can include second table top 122. The second side wall 640 can include recessed pocket 750. The convertible beverage serving station 102 can include second columnar serving tower 128. The convertible beverage serving station 102 can include back door 642. The back door 642 can include locking mechanism 644. The convertible beverage serving station 102 can include shelf 752.

Figure 15:
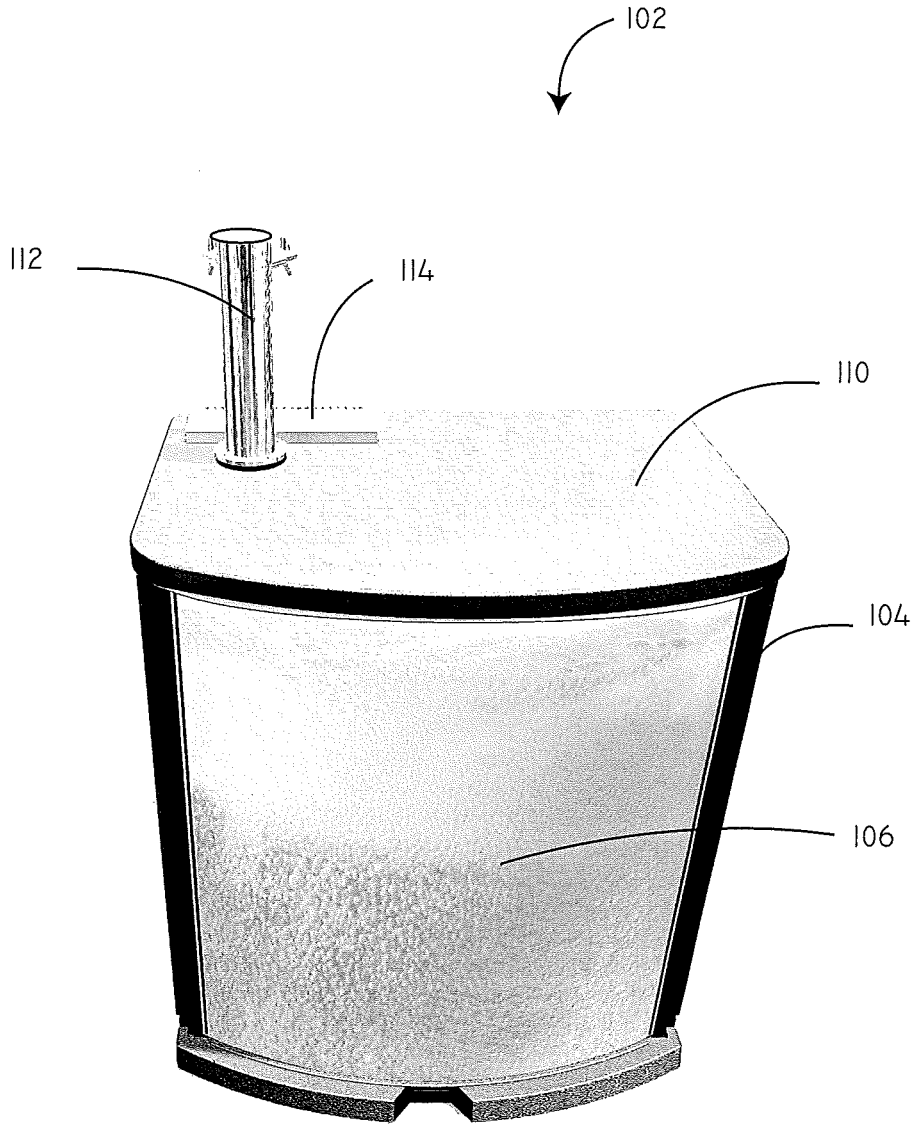
FIG. 15 is a schematic view of a convertible beverage serving station in accordance with various embodiments herein.
Figure 16:
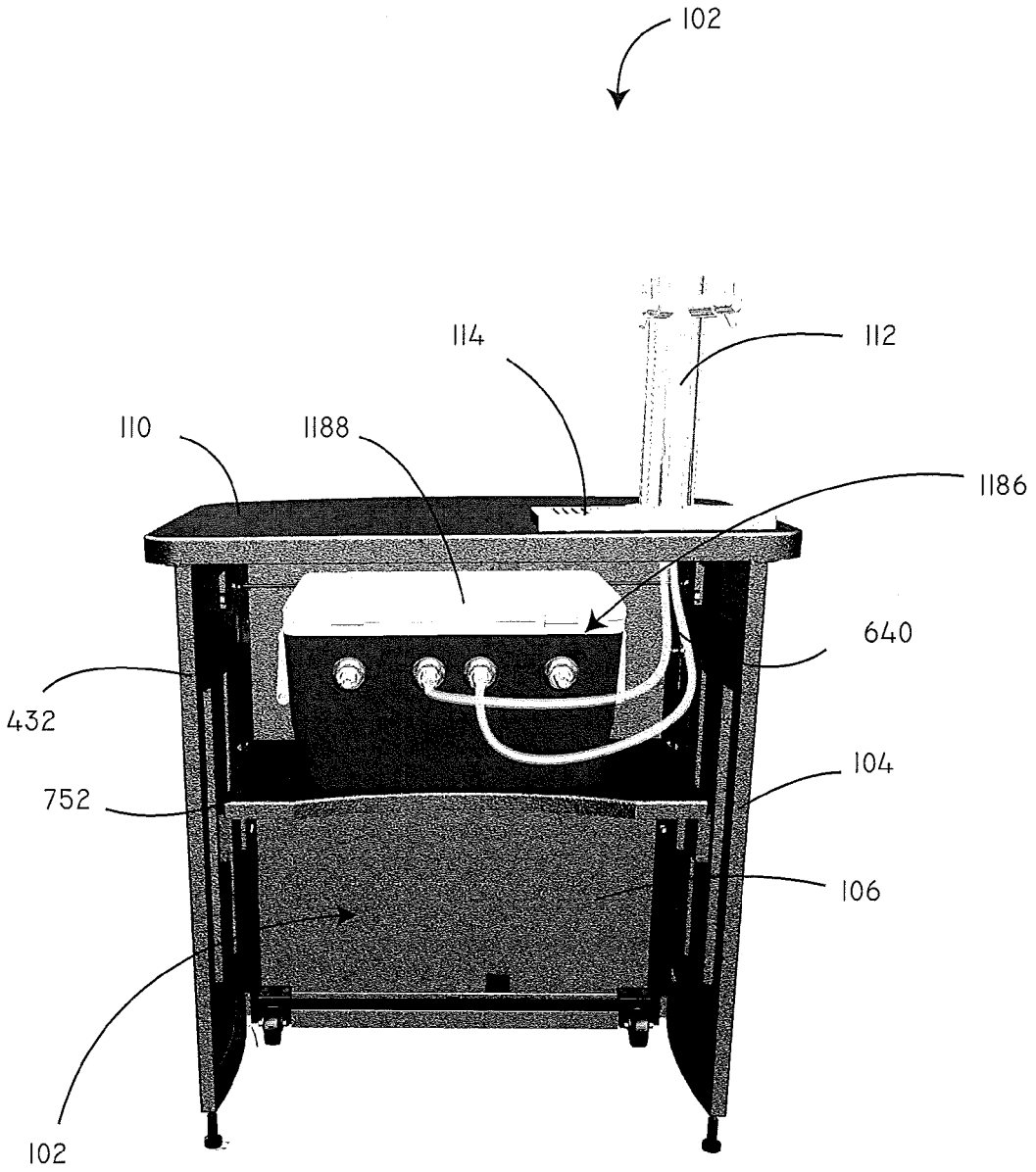
FIG. 16 is a schematic view of a convertible beverage serving station in accordance with various embodiments herein.

It will be appreciated that various components of the convertible beverage serving station can be omitted in certain embodiments. Referring now to FIG. 15, a schematic view of a convertible beverage serving station is shown in accordance with various embodiments herein. The convertible beverage serving station 102 includes a housing 104, a substantially planar serving platform 110, and a first columnar serving tower 112. The substantially planar serving platform 110 can include grate 114. The housing 104 can include a front wall 106. In this embodiment, a base 108 can be omitted. Referring now to FIG. 16, a schematic view of a convertible beverage serving station is shown in accordance with various embodiments herein. The housing 104 includes an interior 746, a front wall 106, a first side wall 432, and a second side wall 640. The convertible beverage serving station 102 can include fluid connection manifold 1186. The fluid connection manifold 1186 can include insulated box 1188. The convertible beverage serving station 102 can include shelf 752.

Figure 17:
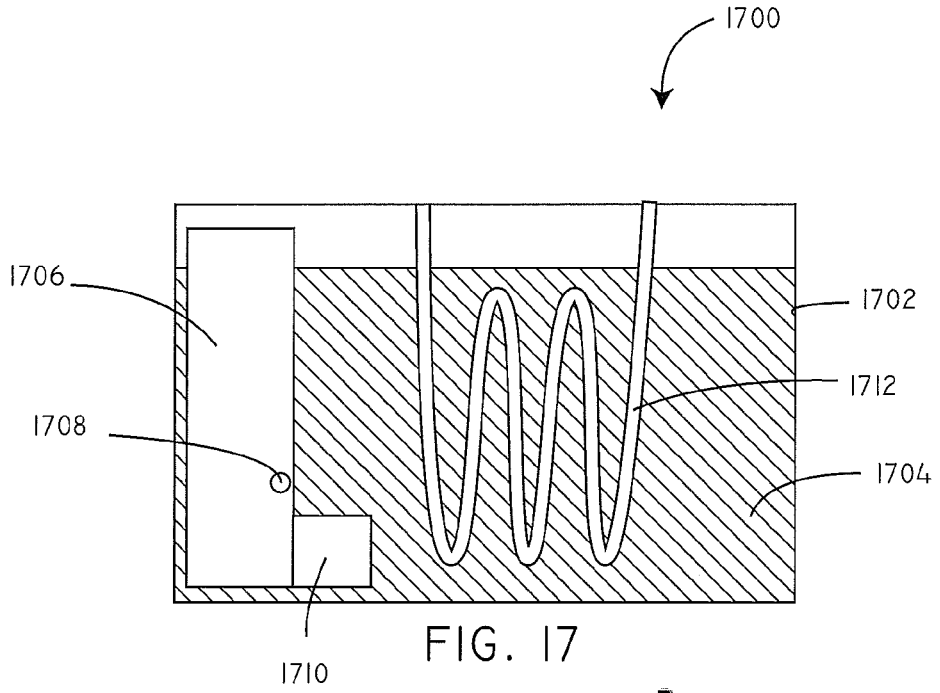
FIG. 17 is a schematic view of an ice bank chiller in accordance with various embodiments herein.

In some embodiments, the convertible beverage serving station can include an electrically powered ice bank chiller. Referring now to FIG. 17, a schematic view of an ice bank chiller 1700 is shown in accordance with various embodiments herein. The ice bank chiller 1700 can include a liquid bath 1704 through which liquid delivery tubes 1712 pass. The ice bank chiller 1700 can include an electrically powered (such as AC or DC current) chilling module 1706 which serves to chill the liquid in the liquid bath 1704. The ice bank chiller 1700 can also include a recirculation mechanism 1710 (such as a recirculation pump) to cause movement of the liquid in the liquid bath 1704 and allow for the liquid to become super-cooled without freezing into a solid mass (although in many cases ice will form in some portions of the liquid bath 1704). The ice bank chiller 1700 can also include a thermal sensor 1708 to determine the current temperature of the liquid bath 1704 can engage the chilling module 1706 to adjust the temperature of the liquid bath 1704 to a desired level. In some embodiments, the liquid bath 1704 is water. In some embodiments, the water is super-cooled to below 32 degrees Fahrenheit.

Figure 18:
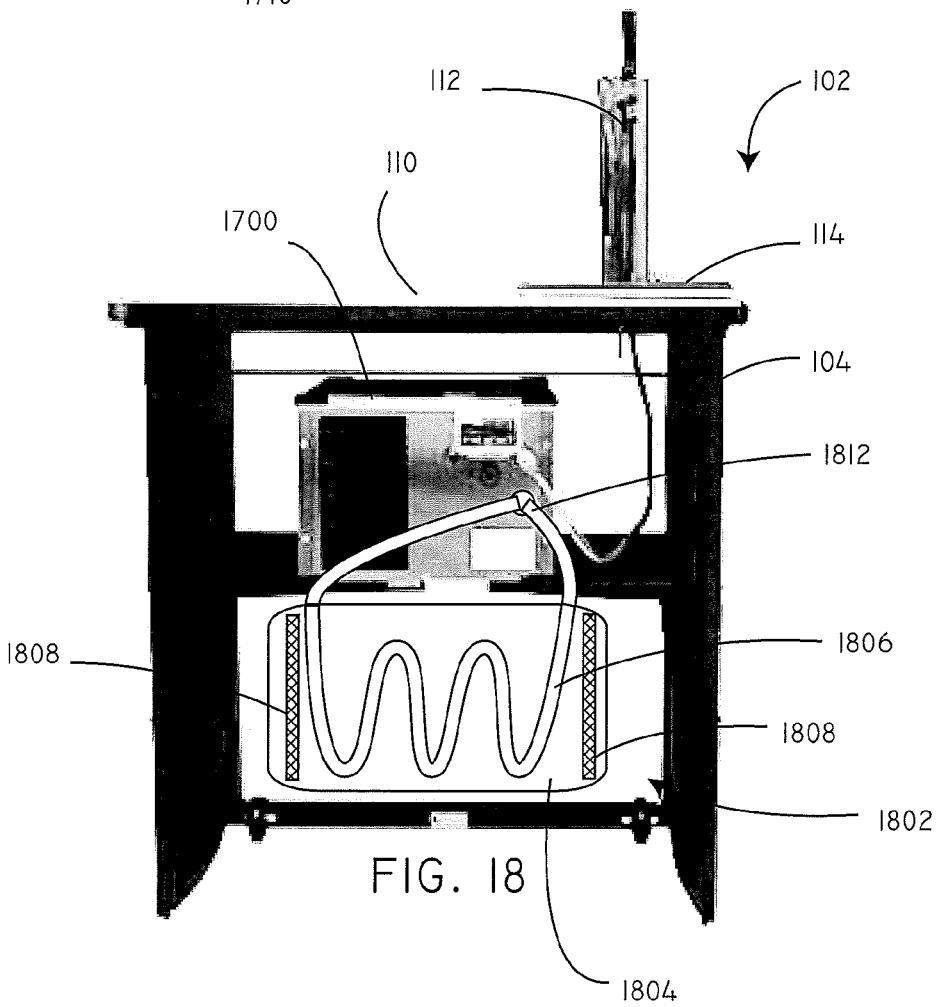
FIG. 18 is a schematic view of a convertible beverage serving station in accordance with various embodiments herein.

Referring now to FIG. 18, a schematic view of a convertible beverage serving station 102 is shown in accordance with various embodiments herein. The convertible beverage serving station 102 includes a housing 104, a substantially planar serving platform 110, and a first columnar serving tower 112. The substantially planar serving platform 110 can also include grate (or drip tray) 114. The convertible beverage serving station 102 can also include an ice bank chiller 1700 which can be operatively connected to a fluid delivery conduit to provide chilled beverage to the first columnar serving tower 112. In some embodiments, the ice bank chiller 1700 can include a chilled fluid distribution port 1812 to route a chilled liquid to a cooling cover 1802. The cooling cover 1802 can be wrapped around a fluid vessel, such as a beer barrel or a wine cask. The cooling cover 1802 can include a chilling fluid conduit 1806 through which a chilled liquid from the ice bank chiller 1700 can flow. The cooling cover 1802 can also include a blanket 1804 and closure mechanisms 1808 (such as VELCRO strips or rows of snaps) to secure the cooling cover 1802 around a fluid vessel. While the cooling cover 1802 is shown in a opened, substantially planar configuration, it will be appreciated that in use it is wrapped around a fluid vessel forming a partially cylindrical orientation.

In some embodiments, attachment pucks, such as those used with columnar serving towers herein can include light emitters. An attachment puck 1077 is shown in FIG. 10. In some embodiments, the attachment puck can be formed of a translucent material. By way of example, the attachment puck can be formed of glass or a translucent polymer (such as LUCITE or the like). In some embodiments, light emitters such as light emitting diodes (LEDs) or incandescent bulbs can be disposed within or adjacent to the attachment puck such that light is transmitted out from the attachment puck when the columnar serving tower is mounted onto a convertible beverage serving station using, for example, a releasable mounting interface.

Figure 19:
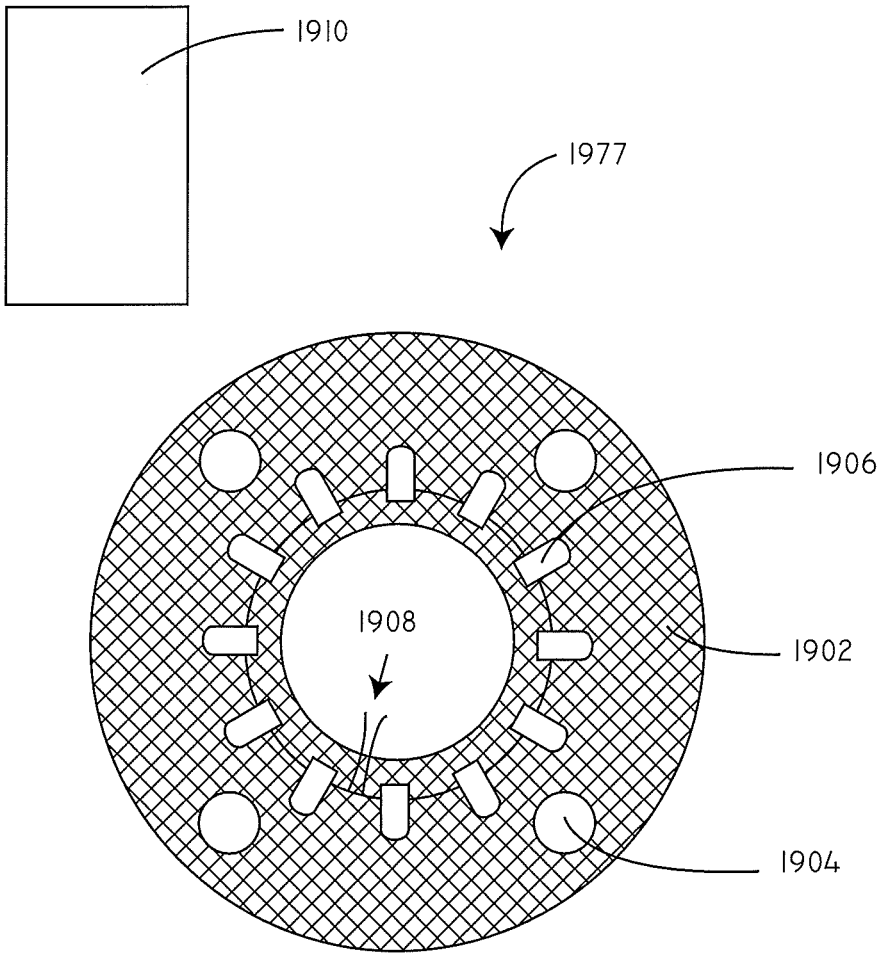
FIG. 19 is a schematic view of an attachment puck in accordance with various embodiments herein.

Referring now to FIG. 19, a schematic view of an attachment puck 1977 is shown in accordance with various embodiments herein. The attachment puck 1977 can include a translucent body 1902. In some embodiments, the translucent body 1902 can include and a plurality of apertures 1904 (for the passage of mounting hardware such as pins, bolts, etc.). The attachment puck 1977 can also include a plurality of light emitters 1906. In some embodiments, the light emitters 1906 can be arranged concentrically around the attachment puck 1977. In some embodiments, the light emitters 1906 can be embedded within the translucent body 1902. In other embodiments, the light emitters 1906 can be disposed adjacent to the translucent body 1902 such as above, below, or on the inner diameter of the translucent body. Electrical conductors 1908 can be included to provide power to the emitters and a control module 1910 can also be included. The control module 1910 can provide for operation of the light emitters 1906 such as the color (which can be fixed or change), patterns of light emission (blinking or constant, rate of blinking, etc.) and the like. In some embodiments, the output of a temperature sensor can be utilized in order to select the color for the emission of light from the light emitters 1906. The light emitters 1906 can be light emitting diodes (LEDs), incandescent bulbs, fluorescent modules, or the like.

The connection device can be configured to allow the serving platform to open upward allowing access to the interior of the housing. The base of the serving station can be connected to the front wall, the first side wall, the second side wall. The one or more orifices on the columnar serving tower can be for dispensing a liquid.

The bottom portion of releasable mounting interface can be configured to pass through one of the apertures in the substantially planar serving platform. The bottom portion can include threads. The top portion of the releasable mounting interface can be configured to mate with the bottom. The releasable mounting interface can include a nut. The nut can have a diameter larger than a diameter of an aperture in the substantially planar serving platform. In some embodiments, the nut can be configured to engage the threads of the bottom portion of the releasable mounting interface.

In some embodiments, the connection arm allows the substantially planar serving platform to be held in an open position. The first columnar serving tower can include a flange. The flange can include apertures. The apertures can be configured to receive fasteners.

The convertible beverage serving station can include a fluid transfer conduit. The fluid transfer conduit can pass from the interior of the housing, through the central channel of the releasable mounting interface and the first columnar serving tower and can provide fluid communication between the one or more orifices on the first columnar serving tower and the interior of the housing.

The first side wall can include an aperture. In some embodiments, the second side wall can also include an aperture. Conduits can pass through apertures such that fluid can effectively be transferred through the apertures.

The first table top can include a front portion. The first table top can include a channel. The channel can be disposed in the front portion and can be configured to receive an attachment element for a skirt member. The convertible beverage serving station can include a first skirt member. The second table top can also include a front portion. The front portion of the second table top can include a channel. The channel can be disposed in the front portion and can be configured to receive an attachment element for a second skirt member.

The first and second side walls can include recessed pockets. The recessed pockets can be where the table tops and legs fit in a folded configuration. The front wall can include channels. The channels can be on the sides of the front wall to receive a graphic panel.

It should be noted that, as used in this specification and the appended claims, the singular forms 'a,' 'an,' and 'the' include plural referents unless the content clearly dictates otherwise. Thus, for example, reference to a composition containing 'a compound' includes a mixture of two or more compounds. It should also be noted that the term 'or' is generally employed in its sense including 'and/or' unless the content clearly dictates otherwise.

It should also be noted that, as used in this specification and the appended claims, the phrase 'configured' describes a system, apparatus, or other structure that is constructed or configured to perform a particular task or adopt a particular configuration to. The phrase 'configured' can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention has been described with reference to various specific and preferred embodiments and techniques. However, it should be understood that many variations and modifications may be made while remaining within the spirit and scope of the invention.

The invention claimed is:

1. A convertible beverage serving station comprising:

a housing defining an interior, the housing comprising a front wall, a first side wall, a second side wall, and a base connected to the front wall, first side wall, and second side wall, a substantially planar serving platform and a connection device interconnecting the substantially planar serving platform and the housing, the connection device configured to allow the serving platform to open upward allowing access to the interior of the housing;

the serving platform comprising at least two apertures;

a columnar serving tower comprising a top and a bottom, the top comprising one or more orifices for dispensing a liquid;

a releasable mounting interface comprising a central channel and a bottom portion configured to pass through one of the apertures in the serving platform and a top portion configured to mate with the bottom of the columnar serving tower;

a first table top and a first leg attached to the first table top, the first side wall comprising a recessed pocket into which the first table top and first leg fits in a folded configuration;

a first skirt member, the first table top further comprising a front portion and a channel disposed in the front portion, the channel configured to receive an attachment element for the first skirt member.

2. The convertible beverage serving station of claim 1, further comprising a connection arm connecting the housing and the substantially planar serving platform, the connection arm allowing the substantially planar serving platform to be held in an open position.

3. The convertible beverage serving station of claim 1, the bottom of the substantially columnar serving tower comprising a flange.

4. The convertible beverage serving station of claim 3, the flange comprising apertures to receive fasteners.

5. The convertible beverage serving station of claim 1, further comprising a nut having a diameter larger than a diameter of the aperture of the serving platform, the bottom portion of the releasable mounting interface comprising threads, the nut configured to engage the threads of the bottom portion of the releasable mounting interface.

6. The convertible beverage serving station of claim 1, further comprising a fluid transfer conduit, the fluid transfer conduit passing from the interior of the housing, through the central channel of the releasable mounting interface and the columnar serving tower and providing fluid communication between the orifice(s) on the columnar serving tower and the interior of the housing.

7. The convertible beverage serving station of claim 1, the first and second side walls further comprising apertures.

8. The convertible beverage serving station of claim 1, further comprising a rectangular depression and a grate to fit at least partially in the rectangular depression.

9. The convertible beverage serving station of claim 8, furthering comprising an aperture passing through the substantially planar serving platform, wherein the aperture is disposed in the rectangular depression.

10. The convertible beverage serving station of claim 9, further comprising a waste fluid disposal conduit providing fluid communication between the aperture disposed in the rectangular depression and the interior of the housing.

11. The convertible beverage serving station of claim 1, further comprising an aperture in the first table top and a stand pole configured to be mounted within the aperture.

12. The convertible beverage serving station of claim 1, further comprising a second table top and a second leg attached to the second table top, the second side wall comprising a recessed pocket into which the second table top and second leg fits in a folded configuration.

13. The convertible beverage serving station of claim 12, further comprising a second skirt member, the second table top further comprising a front portion and a channel disposed in the front portion, the channel configured to receive an attachment element for the second skirt member.

14. The convertible beverage serving station of claim 12, further comprising an aperture in the second table top and a stand pole configured to be mounted within the aperture.

15. The convertible beverage serving station of claim 1, the front wall further comprising channels on the sides of the front wall to receive a graphic panel.

16. The convertible beverage serving station of claim 1, further comprising a fluid connection manifold disposed within the interior of the housing.

17. The convertible beverage serving station of claim 16, the fluid connection manifold comprising an insulated box.

* * * * *